US006670594B1

(12) United States Patent
Jeong et al.

(10) Patent No.: US 6,670,594 B1
(45) Date of Patent: Dec. 30, 2003

(54) WALL-MOUNTED TYPE MICROWAVE OVEN

(75) Inventors: Sang-Jin Jeong, Suwon (KR); Se-Hun Lee, Incheon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/245,566

(22) Filed: Sep. 18, 2002

(30) Foreign Application Priority Data

Jun. 18, 2002 (KR) ..... 2002-33871

(51) Int. Cl.[7] ..... H05B 6/80
(52) U.S. Cl. ..... 219/757; 219/400; 126/299 R
(58) Field of Search ..... 219/757, 756, 219/400, 681; 126/299 R, 299 D, 21 A

(56) References Cited

U.S. PATENT DOCUMENTS 4,045,637 A * 8/1977 Mongeau ..... 200/303
4,593,593 A * 6/1986 Bellini ..... 84/177
5,477,036 A * 12/1995 Jun et al. ..... 219/757
5,766,041 A * 6/1998 Morin et al. ..... 439/609
6,018,158 A * 1/2000 Kang ..... 219/757

OTHER PUBLICATIONS

Patent Abstracts of Japan for Publication No. 02–075824, dated Mar. 15, 1990.

Patent Abstracts of Japan for Publication No. 02–046691, dated Feb. 16, 1990.

* cited by examiner

*Primary Examiner*—Philip H. Leung
(74) *Attorney, Agent, or Firm*—Staas & Halsey LLP

(57) ABSTRACT

A wall-mounted type microwave oven has a simplified construction, reduced manufacturing cost and enhanced productivity by improvement of a fan cover. The microwave oven includes an oven body, an external case to cover the oven body, and which is provided with an opening to allow an exhaust fan to be mounted on the oven body therethrough, and a fan cover integrally formed with the external case and bendable with respect to the external case.

8 Claims, 8 Drawing Sheets

WALL-MOUNTED TYPE MICROWAVE OVEN

CROSS-REFERENCE TO RELATED APPLICATIONS

This application claims the benefit of Korean Application No. 2002-33871, filed Jun. 18, 2002, in the Korean Industrial Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven with an improved fan cover, which is adapted to cover an exhaust fan.

2. Description of the Related Art

FIG. 1 shows a conventional wall-mounted type microwave oven installed over a gas oven range. As shown in FIG. 1, a conventional wall-mounted type microwave oven 1 is generally installed over a gas oven range 1 in a kitchen, and serves to carry out a function of exhausting exhaust gas, fumes and the like, generated from the gas oven range 1 disposed therebelow to the outside. The conventional microwave oven 1 also serves to carry out a cooking function by generating high-frequency electromagnetic waves.

As shown in FIG. 2, the wall-mounted type microwave oven 1 is provided at a rear and upper portion of its oven body 2 with an exhaust fan 3 to exhaust gas and fumes, and is provided therein with an exhaust path, which is extended from a bottom of the oven body 2 to the exhaust fan 3 to suck and guide gas and fumes.

Furthermore, the oven body 2 is provided at its rear and upper portion with a fan-mounting compartment 4 to house the exhaust fan 3. An external case 5 of the oven body 2 is provided at its upper surface with an opening 6, which has an area corresponding to a planar area of the exhaust fan 3 to allow the exhaust fan 3 to be mounted into the fan-mounting compartment 4 therethrough, and to be easily pulled out of the compartment 4. The opening 6 is hingedly equipped with a fan cover 7 to close the opening 6. The fan cover 7 includes discharging ports 8 containing a filter 9 to filter foreign substances.

However, since the conventional wall-mounted type microwave oven 1 is constructed such that the fan cover 7 to cover the exhaust fan 3 is separately manufactured and then coupled to the opening 6, a configuration required to mount the exhaust fan 3 is complicated and a number of components is increased, thereby causing a decrease of productivity and an increase of manufacturing cost.

SUMMARY OF THE INVENTION

Accordingly, it is an object of the present invention to provide a wall-mounted type microwave oven, which is intended to allow an increase of productivity and decrease of manufacturing cost by improving a fan cover.

Additional objects and advantages of the invention will be set forth in part in the description which follows and, in part, will be obvious from the description, or may be learned by practice of the invention.

The foregoing and other objects of the present invention are achieved by providing a wall-mounted type microwave oven including an oven body, an external case adapted to cover the oven body, which is provided with an opening to allow an exhaust fan to be mounted on the oven body therethrough, and a fan cover integrally formed with the external case to close the opening.

According to an aspect of the invention, the fan cover is bent with respect to the external case to be opened and closed.

According to an aspect of the invention, a conjunction portion, at which the fan cover and the external case are connected, is provided at its lower surface with a folding notch line having a certain depth.

According to an aspect of the invention, the fan cover is separated from the external case by two slits forwardly extended from a rear end of the external case, so that a rear free end of the fan cover is opened and closed up and down.

BRIEF DESCRIPTION OF THE DRAWINGS

The above and other objects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
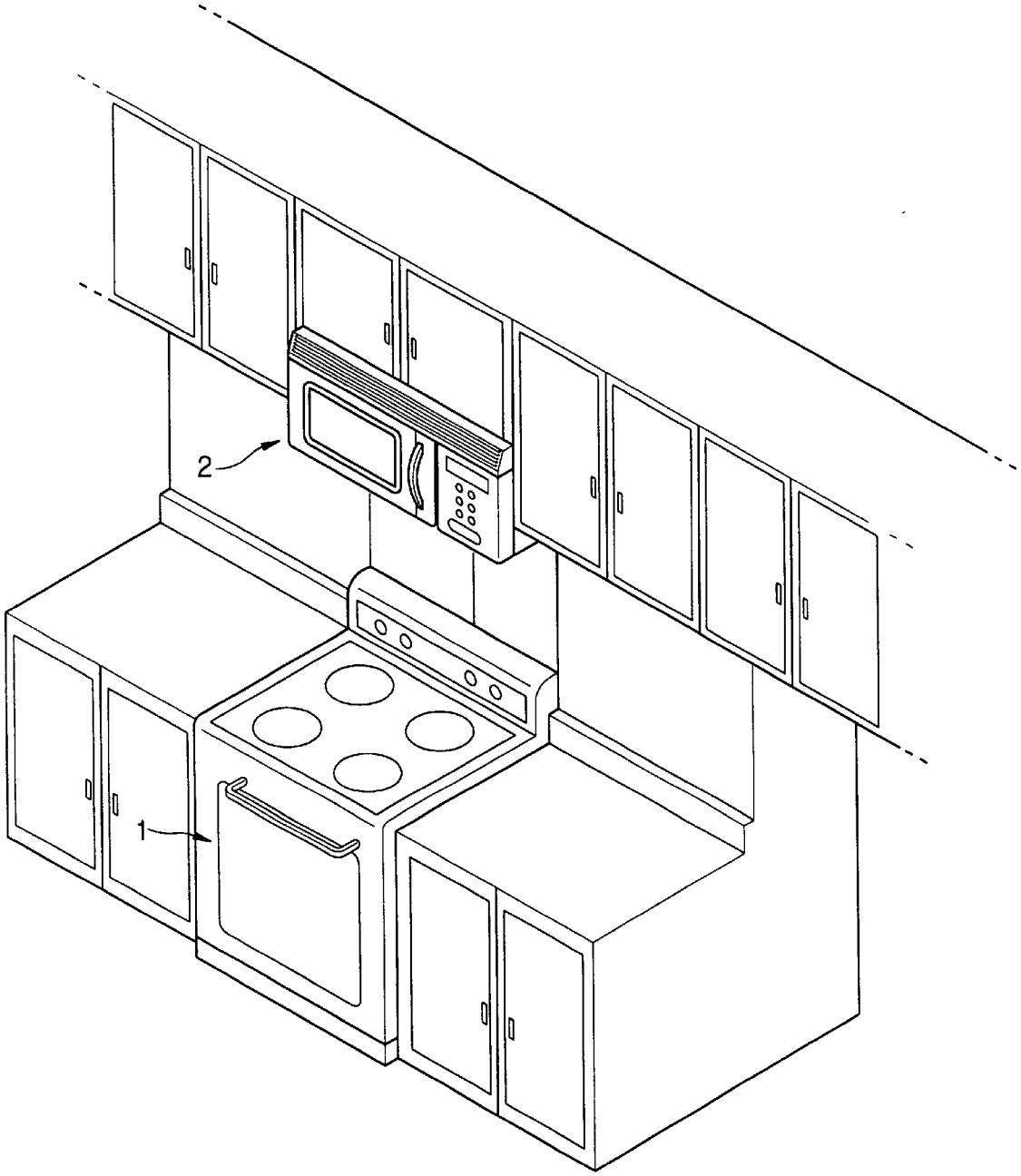
FIG. 1 PRIOR ART
FIG. 1 is a perspective view of a conventional wall-mounted type microwave oven, which is installed above a gas oven range.
Figure 2:
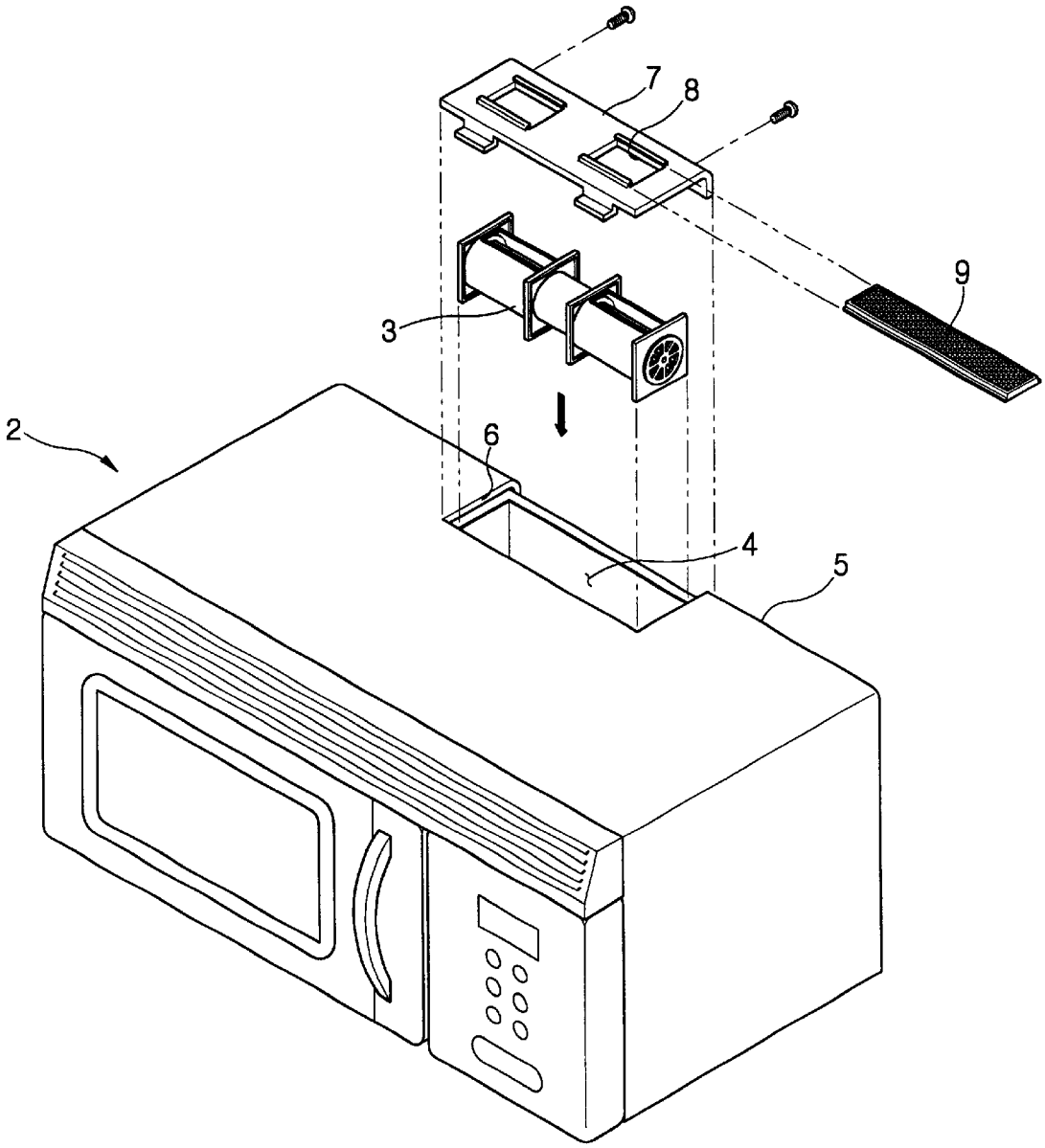
FIG. 2 PRIOR ART
FIG. 2 is a perspective view of a conventional wall-mounted type microwave oven, in which an exhaust fan is removed to show its detailed construction.

Reference will now be made in detail to the present preferred embodiments of the present invention, examples of which are illustrated in the accompanying drawings, wherein like reference numerals refer to like elements throughout.

Figure 3:
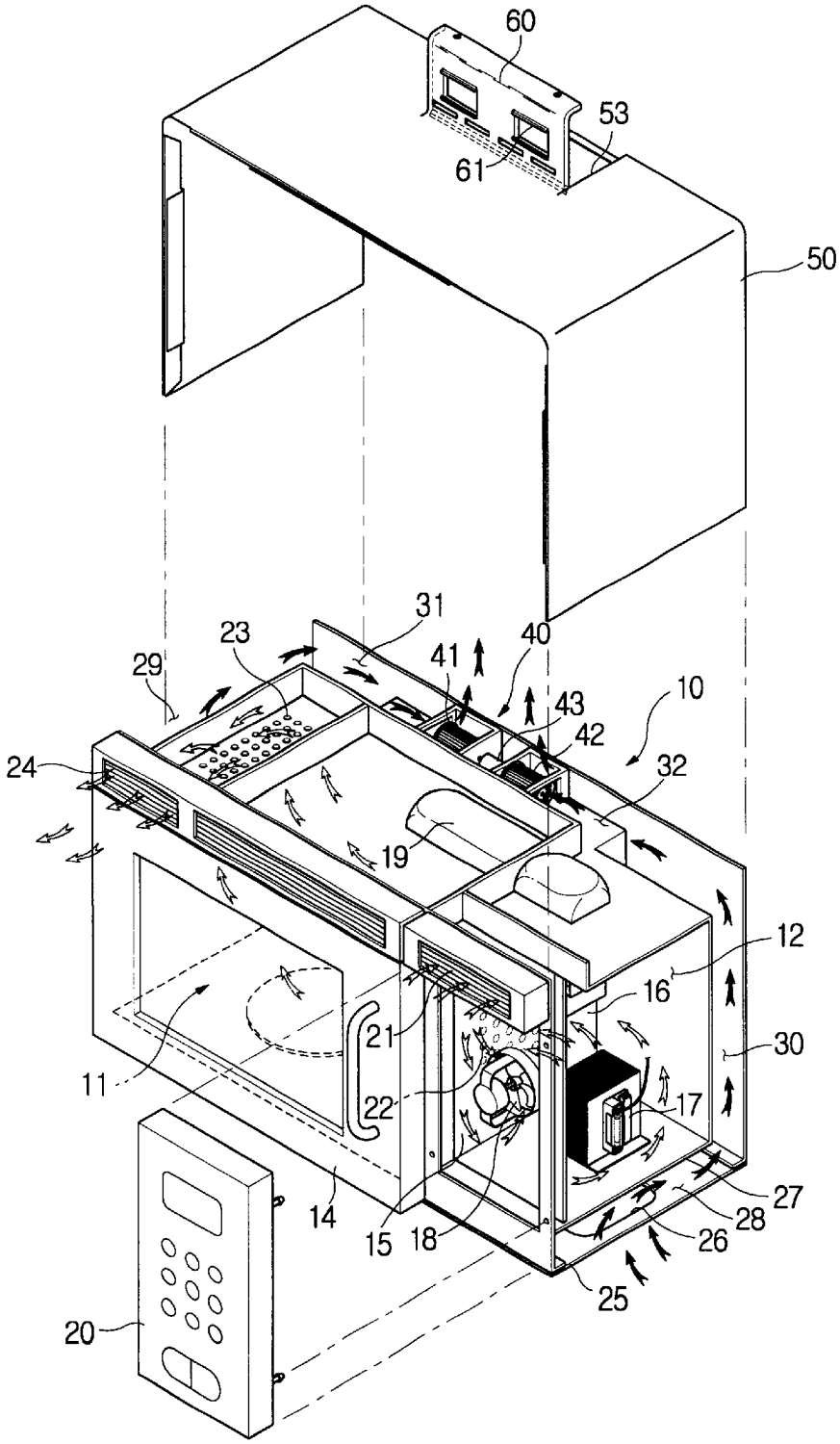
FIG. 3 is a perspective view of a wall-mounted type microwave oven, in which an external case and a control panel are removed to show its interior components, according to an embodiment of the present invention.

As shown in FIG. 3, a wall-mounted type microwave oven according to an embodiment of the present invention includes an oven body 10, which is provided therein with a cooking chamber 11 to receive foods to be cooked, and an electric component compartment 12 to receive various electric components, both of which are isolated from each other.

The cooking chamber 11 is provided at its front face with a door 14 to be closed and opened. The electric component compartment 12 is isolated from the cooking chamber 11 by a partition plate 15. The electric component compartment 12 is provided therein with a magnetron 16 to generate high-frequency electromagnetic waves into the cooking chamber 11, a high voltage transformer 17 to apply high voltage to the magnetron 16, and a cooling fan 18 to cool the electric components received in the electric component compartment 12. The magnetron 16 is mounted on an upper surface of the electric component compartment 12, and the high voltage transformer 17 is mounted on a bottom of the electric component compartment 12. A waveguide 19 is provided on upper surfaces of the cooking chamber 11 and the electric component compartment 12, such that the waveguide 19 is extended between both centers of the upper surfaces of the cooking chamber 11 and the electric component compartment 12. The waveguide 19 serves to guide high-frequency electromagnetic waves generated from the magnetron 16 into the cooking chamber 11. The electric component compartment 12 is further provided at its front face with a control panel 20 equipped with a plurality of control buttons to control various functions, and a display to indicate an operational condition of the microwave oven.

The microwave oven according to the present invention further includes an air flow path, which is adapted to allow outside air to be introduced into the electric component compartment 12 and the cooking chamber 11, and then discharged to the outside, so as to provide cooling of the electric component compartment 12 and ventilation of the cooking chamber 11. The air flow path includes a front air inlet 21 disposed over the control panel 20 and communicating with the electric component compartment 12. The air flow path also includes a plurality of vent holes 22 formed at the partition plate 15 to allow air introduced into the electric component compartment 12 through the front air inlet 21 to be introduced into the cooking chamber 11 while cooling the electric component compartment 12. The air flow path is further provided with a plurality of vent holes 23 formed at the upper surface of the cooking chamber 11, and a front air outlet 24 disposed at an upper portion of a front face of the cooking chamber 11, to allow air in the cooking chamber 11 to be discharged to an outside therethrough.

By the airflow path, when the cooking fan 18 is operated, the outside air is introduced into the electric component compartment 12 through the front air inlet 21 to cool the components in the electric component compartment 12, and then introduced into the cooking chamber 11 through the vent holes 22 of the partition plate 15 to ventilate the cooking chamber 11. Subsequently, the air in the cooking chamber 11 is discharged to the outside through the vent holes 23 and the front air outlet 24.

Further, the wall-mounted type microwave oven according to the present invention includes an exhaust flow path, which is constructed to be isolated from the cooking chamber 11 and the electric component compartment 12 to exhaust gas and fumes generated from a gas oven range (not shown) disposed below the oven body 10. Accordingly, the oven body 10 is provided at its upper and rear portion with an exhaust fan assembly 40 to discharge gas and fumes introduced into the exhaust flow path to the outside.

The exhaust flow path includes an intake port 26 formed at a bottom panel 25 of the oven body 10, and a lower path section 28 defined between bottom plates of the cooking chamber 11 and the electric component compartment 12, and the bottom panel 25 of the oven body 10. The exhaust flow path further includes two rising path sections 29 and 30 defined between a side plate of the cooking chamber 11 and a rear plate of the electric compartment 12 and panels of the oven body 10. The exhaust flow path includes two upper path sections 31 and 32 disposed on the oven body 10, which serve to guide the gas and fumes introduced into the rising path sections 29 and 30 toward the exhaust fan assembly 40. Accordingly, when the exhaust fan assembly 40 is operated, gas and fumes sucked through the intake port 26 of the bottom panel 25 are discharged to the outside through the lower path section 28, the two rising path sections 29 and 30, and the two upper path sections 31 and 32.

Figure 4:
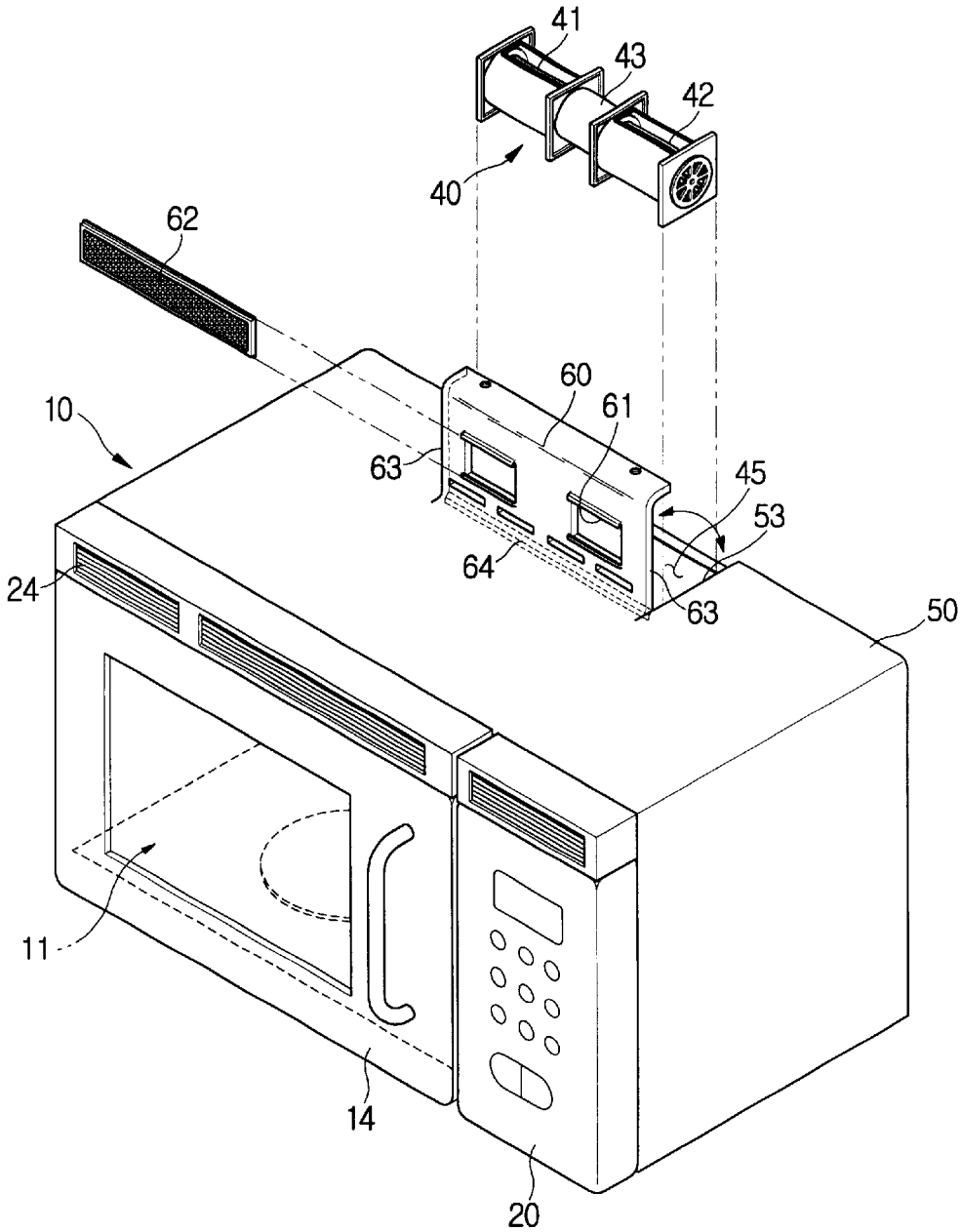
FIG. 4 is a perspective view of the wall-mounted type microwave oven of FIG. 3, which shows a structure required to mount an exhaust fan.
Figure 5:
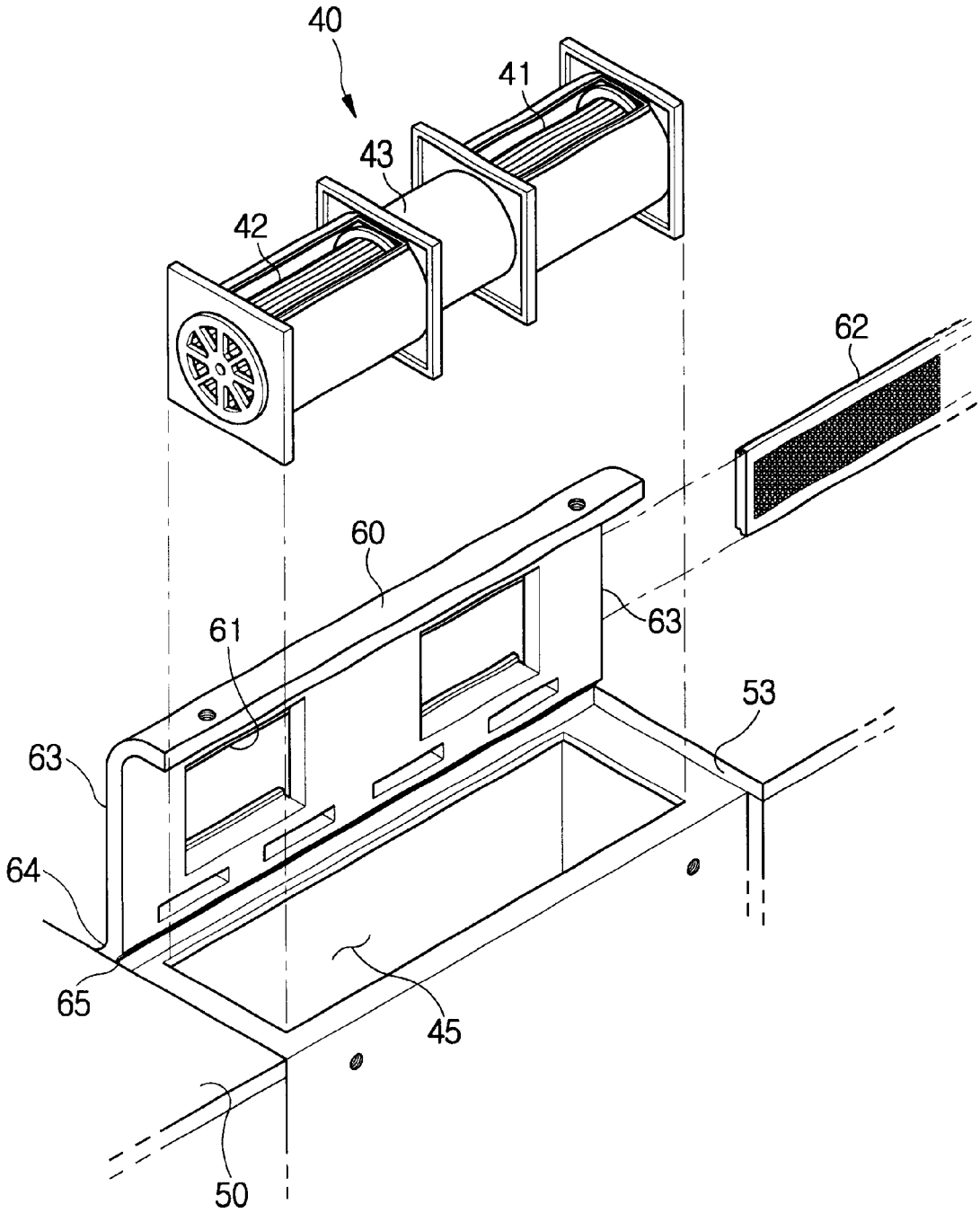
FIG. 5 is an enlarged perspective view of the structure to mount the exhaust fan of FIG. 3.

As shown in FIGS. 3 through 5, the exhaust fan assembly 40 includes first and second fans 41 and 42 to discharge gas and fumes introduced into the two rising path sections 29 and 30, and a motor 43 interposed between the first and second fan elements 41 and 42 to rotate the first and second fans 41 and 42.

The exhaust fan assembly 40 is mounted on the oven body 10 such that the exhaust fan assembly 40 is received in a fan-mounting compartment 45 of the oven body 10. An external case 50 of the oven body 10 is formed with an opening 53 at a position corresponding to the exhaust fan assembly 40 to allow the exhaust fan assembly 40 to be mounted on and separated from the oven body 10 therethrough. The opening 53 is provided with a fan cover 60, which has discharging ports 61 through which gas and fumes are discharged. The discharging ports 61 of the fan cover 60 are provided with filters 62 to filter foreign substances contained in the gas and fumes.

As shown in FIG. 4, the fan cover 60 and the opening 53 enable the exhaust fan assembly 40 to be easily mounted on the oven body 10 therethrough even though the external case 50 is attached to the oven body 10 in advance, and to be easily separated from the oven body 10 when there is need to replace the exhaust fan assembly 40 with a new one or to repair the exhaust fan assembly 40.

According to the present invention, the fan cover 60 is integrally formed with the external case 50. More specifically, the fan cover 60 is formed in the course of manufacturing the external case 50 by carrying out a press working of a steel plate, such that the fan cover 60 is connected to an edge of the external case 50 defining the opening 53. By this integral configuration of the fan cover 60 and the external case 50, a number of components required to manufacture a microwave oven and manufacturing cost are reduced, resulting in simplification of its manufacturing process and improvement of productivity.

Since the fan cover 60 is raised from the external case 50 in a hinge manner by two slits 63 forwardly extended from a rear end of the external case 50 by a length corresponding to a width of the fan cover 60, a rear end of the fan cover 60 may be opened and closed up and down. The slits 63 are formed during the press working of the external case 50.

Figure 6:
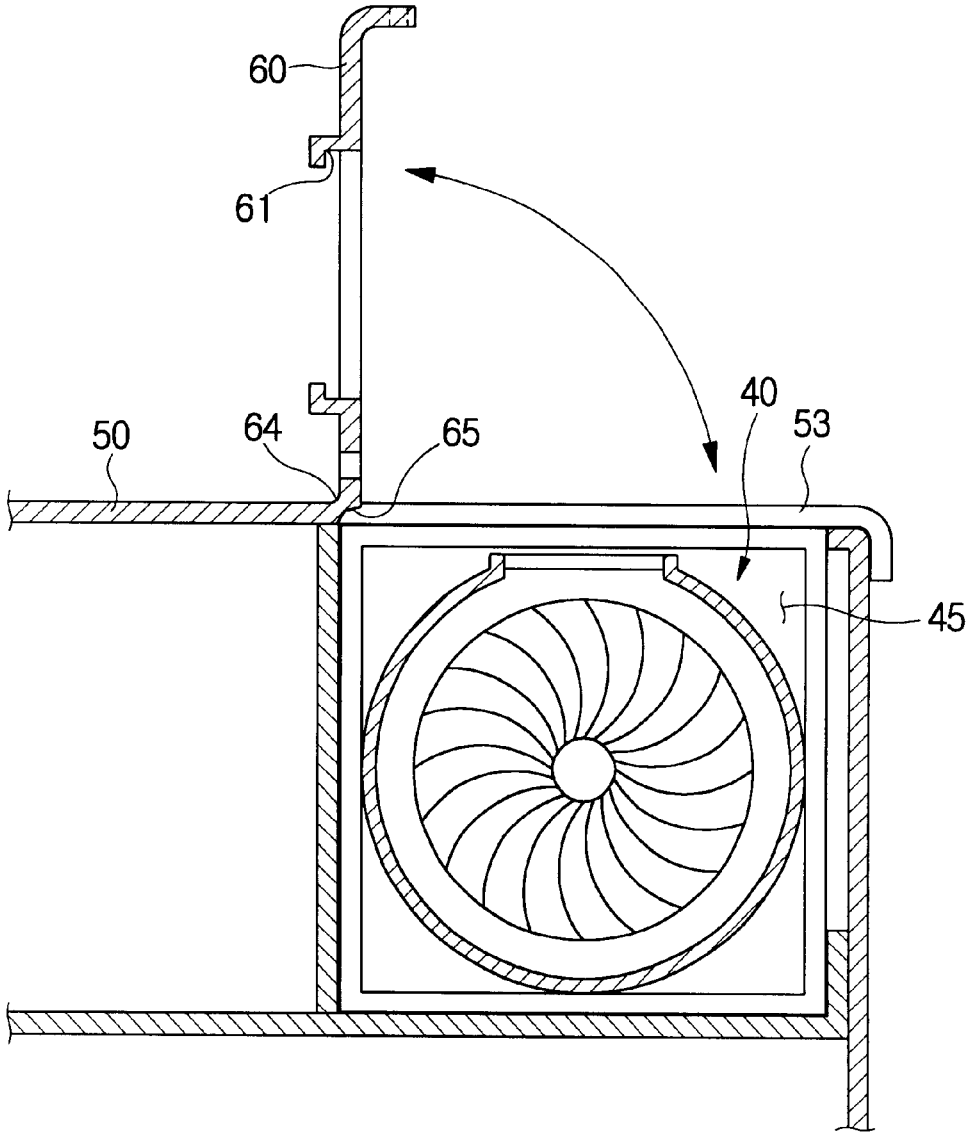
FIG. 6 is a cross-sectional view of the structure to mount the exhaust fan, in which a fan cover is opened.
Figure 7:
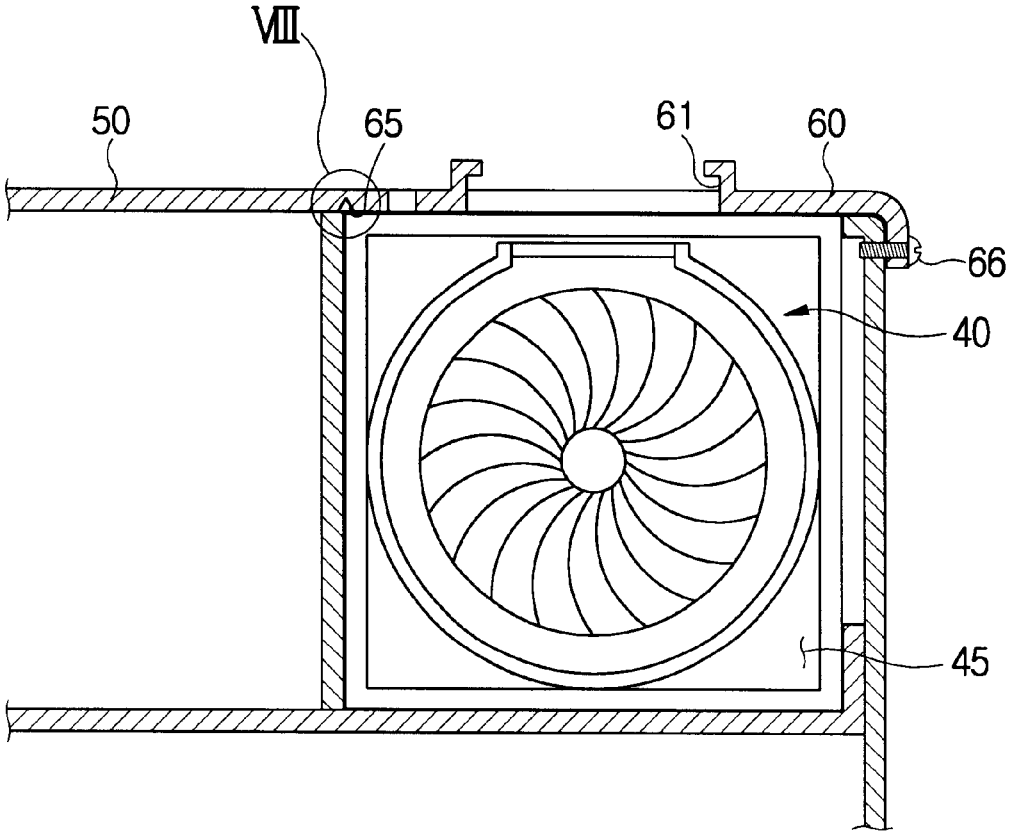
FIG. 7 is a view similar to FIG. 6, in which the fan cover is closed.
Figure 8:
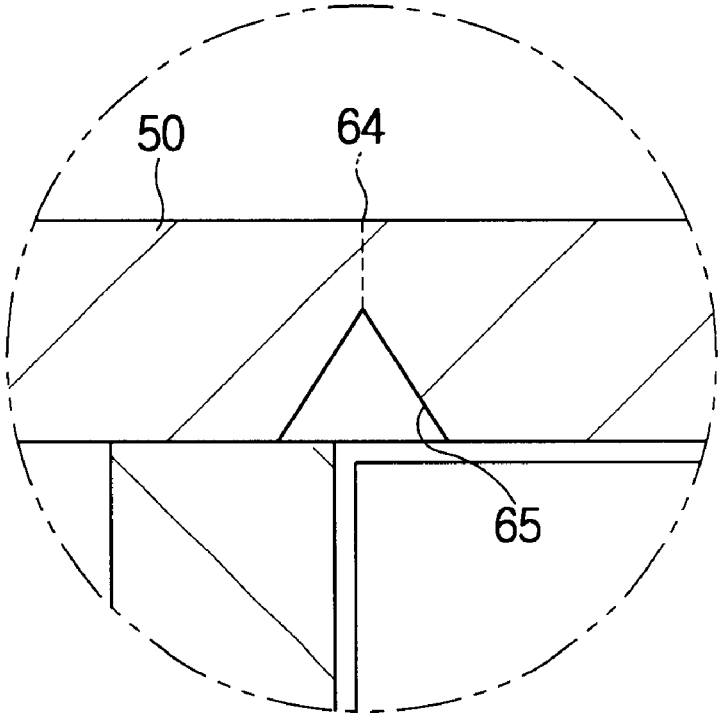
FIG. 8 is an enlarged cross-sectional view of circle VIII of FIG. 7.

As shown in FIGS. 6 through 8, a conjunction portion 64, at which the fan cover 60 and the external case 50 are connected, is formed at its lower surface with a folding notch line 65 having a certain depth. Since the conjunction portion 64 is weak compared to other portions of the external case 50 due to the folding notch line 65, the fan cover 60 is easily bent at the conjunction portion 64, thereby facilitating opening and closing of the fan cover 60. The rear side of the fan cover 60 is fixedly attached to the external case 50 by screws 66, as shown in FIG. 7.

As described above, since a wall-mounted type microwave oven is constructed such that a fan cover is integrally formed with an external case, its construction is simplified due to a decreased number of components, and thus improvement in productivity and reduction of manufacturing cost are obtained.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A wall-mounted type microwave oven, comprising:

an oven body;

an external case to cover the oven body, which is provided with an opening to allow an exhaust fan to be mounted on the oven body therethrough; and a fan cover integrally formed with the external case to close the opening.

2. The wall-mounted type microwave oven as set forth in claim 1, in which the fan cover is bendable with respect to the external case, to be opened and closed.

3. The wall-mounted type microwave oven as set forth in claim 1, further comprising:

a conjunction portion, at which the fan cover and the external case are connected, formed at a lower surface thereof with a folding notch line having a certain depth.

4. The wall-mounted type microwave oven as set forth in claim 1, in which the fan cover is separated from the external case by first and second slits forwardly extended from a rear end of the external case, so that a rear free end of the fan cover is opened and closed up and down.

5. A method of manufacturing a wall-mounted type microwave oven having an external case to cover an oven body, comprising:

integrally forming a fan cover with the external case, the fan cover being bendable with respect to the external case to be opened and closed.

6. The method of claim 5, further comprising:

forming a conjunction to connect the fan cover and the external case, the conjunction being formed at a lower surface thereof with a folding notch to easily bend the fan cover at the conjunction.

7. The method of claim 5, wherein the fan cover is formed by cutting portions of the external case.

8. The method of claim 5, further comprising:

forming first and second slits on opposite sides of the fan cover, wherein the first and second slits forwardly extend from a rear end of the external case, so that a rear free end of the fan cover is opened and closed.

* * * * *